US009047825B2

(12) United States Patent
Matsui

(10) Patent No.: US 9,047,825 B2
(45) Date of Patent: Jun. 2, 2015

(54) DISPLAY DEVICE AND DISPLAY METHOD

(75) Inventor: Katsuyuki Matsui, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 0 days.

(21) Appl. No.: 14/116,118

(22) PCT Filed: May 31, 2011

(86) PCT No.: PCT/JP2011/062502

§ 371 (c)(1),
(2), (4) Date: Nov. 6, 2013

(87) PCT Pub. No.: WO2012/164688

PCT Pub. Date: Dec. 6, 2012

(65) Prior Publication Data

US 2014/0071187 A1 Mar. 13, 2014

(51) Int. Cl.

*G09G 3/34* (2006.01)
*G09G 3/20* (2006.01)
*G09G 3/36* (2006.01)

(52) U.S. Cl.

CPC ..... *G09G 3/3406* (2013.01); *G09G 3/3413* (2013.01); *G09G 3/20* (2013.01); *G09G 3/34* (2013.01); *G09G 3/36* (2013.01); *G09G 3/3648* (2013.01)

(58) Field of Classification Search

CPC ..... G09G 2320/0666; G09G 3/3413; G09G 3/3406; G09G 3/36
USPC ..... 345/87–102, 589, 690; 348/655, 687
See application file for complete search history.

(56) References Cited

U.S. PATENT DOCUMENTS 6,862,012 B1 * 3/2005 Funakoshi et al. ..... 345/88
2002/0057252 A1 * 5/2002 Onodera ..... 345/102

(Continued)

FOREIGN PATENT DOCUMENTS

JP 2004-094231 A 3/2004
JP 2004-159986 A 6/2004

(Continued)

OTHER PUBLICATIONS

International Search Report in PCT/JP2011/062502 dated Jul. 5, 2011 (English Translation Thereof).

(Continued)

*Primary Examiner* — Hong Zhou
(74) *Attorney, Agent, or Firm* — McGinn IP Law Group, PLLC

(57) ABSTRACT

A display device includes a calculation unit which calculates a required luminance according to a set luminance for each color of a backlight, for each of a first video signal and a second video signal, and obtains the higher of the required luminance corresponding to the first video signal and the required luminance corresponding to the second video signal as an objective luminance for each color based on a calculation result, a backlight driving unit which drives the backlight for each color according to the obtained objective luminance of each color, a detection unit which compares the required luminance with the objective luminance and detects, for each color, the required luminance corresponding to the video signal lower than the objective luminance, and a brightness adjustment unit which performs adjustment for each color so that an image corresponding to the video signal lower than the objective luminance is darkened.

2 Claims, 5 Drawing Sheets

(56) References Cited

U.S. PATENT DOCUMENTS

| | | | | |
|---|---|---|---|---|
| 2005/0219198 | A1* | 10/2005 | Pasqualini et al. | 345/102 |
| 2007/0081720 | A1* | 4/2007 | Ok et al. | 382/162 |
| 2008/0055228 | A1* | 3/2008 | Glen | 345/102 |
| 2010/0085297 | A1* | 4/2010 | De Greef | 345/102 |
| 2011/0096103 | A1* | 4/2011 | Kato | 345/690 |
| 2011/0181565 | A1* | 7/2011 | Asamura et al. | 345/207 |

FOREIGN PATENT DOCUMENTS

| | | | |
|---|---|---|---|
| JP | 2005-521905 | A | 7/2005 |
| JP | 2006-145836 | A | 6/2006 |
| JP | 2008-90076 | A | 4/2008 |
| JP | 2008-304907 | A | 12/2008 |
| JP | 2009-053687 | A | 3/2009 |
| JP | 2009-116226 | A | 5/2009 |
| JP | 2010-026456 | A | 2/2010 |
| JP | 2010-145627 | A | 7/2010 |
| JP | 2011-033985 | A | 2/2011 |
| WO | WO 2011/132236 | A1 | 10/2011 |

OTHER PUBLICATIONS

Japanese Office Action dated Nov. 18, 2014 with a partial English translation thereof.

Japanese Notice of Allowance dated Feb. 24, 2015 with an English translation thereof.

* cited by examiner

DISPLAY DEVICE AND DISPLAY METHOD

TECHNICAL FIELD

The present invention relates to a display device in which a plurality of primary color backlights for different colors are provided.

BACKGROUND ART

In industrial fields in which strict color reproduction is required, color reproduction of a subject corresponding to an illumination environment is required. Further, in a standard illumination environment, for example, a color temperature is 5000 K in the field of printing and 6500 K in HDTV (high-definition television), and varies with the fields of use.

In order to confirm tones of colors in such different fields of use, simultaneously displaying a plurality of images having different white point settings within one screen is required in a display device.

A display device which simultaneously displays a plurality of screens having different white point luminance and chromaticity within one screen when a luminance of a screen A which is a screen corresponding to a first video signal is for example 80 cd/m$^2$ and a luminance of a screen B which is a screen corresponding to a second video signal is for example 70 cd/m$^2$ will be described by way of example. Usually, in a display device having a multicolor backlight in which backlights for different colors are combined, adjustment of a luminance and chromaticity (e.g., luminance: 80 cd/m$^2$ and color temperature: 5000 K) of a white point is performed by changing an optical output for a color of each backlight.

Thus, adjustment of the backlight to the luminance and chromaticity of the screen A having a highest set luminance and adjustment of a video signal for a screen group (screen B) having a lower luminance to be darkened is considered for easy implementation.

Further, technology for displaying two images on one screen based on a plurality of video signals is described in Patent Document 1 described below.

DOCUMENTS OF THE PRIOR ART

Patent Document

[Patent Document 1]

Patent Document 1: Japanese Unexamined Patent Application, First Publication No. 2004-094231

DISCLOSURE OF INVENTION

Problems to be Solved by the Invention

However, in the scheme described above, there are problems in that the luminance of the screen B is degraded and the chromaticity does not fit, and the white point desired for the screen B cannot be displayed simultaneously with the screen A.

Hereinafter, an example in which screens A and B (FIG. 8) having different image quality settings are displayed on one display device will be described. In this case, a display state of the screen having a lower luminance, namely, the screen B, is shown in FIGS. 6 and 7.

FIG. 6 is a diagram illustrating a relationship between a wavelength of a backlight and an optical output when two screens are displayed by one display device. Wavelengths of a backlight in cases of three colors, blue (B), green (G) and red (R), are illustrated.

In FIG. 6, a case in which the luminance and chromaticity of the backlight is fitted to the screen A and the luminance (green light output herein) is adjusted by darkening an image of the screen B is illustrated. In this case, a ratio of optical outputs of R, G, and B included in white displayed on the screen B is different from a white point setting value (required luminance of the screen B) of a user. In other words, the white point setting value of the user and a real chromaticity in the screen B do not match. Here, states (reference signs a, b and c) of optical outputs corresponding to the required luminances in the screen B and states (reference signs e, f and g) of optical outputs when an image displayed on the screen B is actually output do not match.

FIG. 7 is a diagram illustrating a relationship between a wavelength of a backlight and an optical output when chromaticity is fitted to a setting value by further adjusting a video signal from the states of FIG. 6. Here, a ratio of optical outputs (reference signs a, b and c) of R, G and B included in white displayed in the screen B matches a white point setting value of a user, but the optical outputs (reference signs d, e and f) of the colors when actually displayed on the screen B is greatly insufficient and the luminance is degraded.

A cause of such a problem is that there is a backlight color darker than that of the screen B even in the screen A having a higher luminance when the luminance of each backlight color to be included in white of the screen is calculated. FIG. 8 is a diagram illustrating required backlight luminances for each screen. A backlight is driven based on optical outputs (reference signs d, e and f) corresponding to required luminances in a screen A among optical outputs (reference signs a, b and c) corresponding to required luminances in a screen B and the optical outputs (reference signs d, e and f) corresponding to the required luminance in the screen A, as shown in FIG. 8. Then, in blue, the luminance is insufficient because the optical output corresponding to the required luminance of the screen B is higher than the optical output corresponding to the required luminance of the screen A.

A problem to be solved is that desired white points cannot be displayed simultaneously when screens corresponding to a plurality of video signals are displayed on a screen of one display device.

Means for Solving the Problem

The present invention is characterized by a display device in which a plurality of backlights for different primary colors are provided and a liquid crystal panel is irradiated from a display back surface by the backlights to display a color image, the display device comprising: a display unit which displays two images of a first video signal and a second video signal on one screen; a luminance and color temperature setting unit which sets a luminance and a color temperature of white points of the first video signal and the second video signal; a calculation unit which calculates, for each of the colors of the backlights, a required luminance according to the set luminance for each of the first video signal and the second video signal, and obtains the higher one of the required luminance corresponding to the first video signal and the required luminance corresponding to the second video signal as an objective luminance for each color based on a calculation result; a backlight driving unit which drives the backlight for each color according to the objective luminance for each color obtained by the calculation unit; a detection unit which compares the required luminance with the objective luminance and detects, for each color, the required luminance corresponding to the video signal lower than the objective luminance among the required luminance corresponding to the first video signal and the required luminance corresponding to the second video signal; and a brightness adjustment unit which performs adjustment for each color so that an image corresponding to the video signal lower than the objective luminance among the required luminance corresponding to the first video signal and the required luminance corresponding to the second video signal is darkened according to a detection result of the detection unit.

Further, the present invention is characterized by a display method in a display device in which a plurality of backlights for different primary colors are provided and a liquid crystal panel is irradiated from a display back surface by the backlights to display a color image, the display method comprising: receiving an input to set a luminance and a color temperature of white points of a first video signal and a second video signal; calculating, for each of the colors of the backlights, a required luminance according to the set luminance for each of the first video signal and the second video signal, and obtaining the higher one of the required luminance corresponding to the first video signal and the required luminance corresponding to the second video signal as an objective luminance for each color based on a calculation result; driving the backlight for each color according to the obtained objective luminance of each color; comparing the required luminance with the objective luminance and detecting, for each color, the required luminance corresponding to the video signal lower than the objective luminance among the required luminance corresponding to the first video signal and the required luminance corresponding to the second video signal; performing adjustment for each color so that an image corresponding to the video signal lower than the objective luminance among the required luminance corresponding to the first video signal and the required luminance corresponding to the second video signal is darkened according to a detection result; and displaying two images of the first video signal and the second video signal on one screen according to an adjustment result.

Effects of the Invention

It is possible to display a plurality of images having different white point luminance and chromaticity settings on a display screen of one display device according to a desired white point.

EMBODIMENTS FOR CARRYING OUT THE INVENTION

Figure 1:
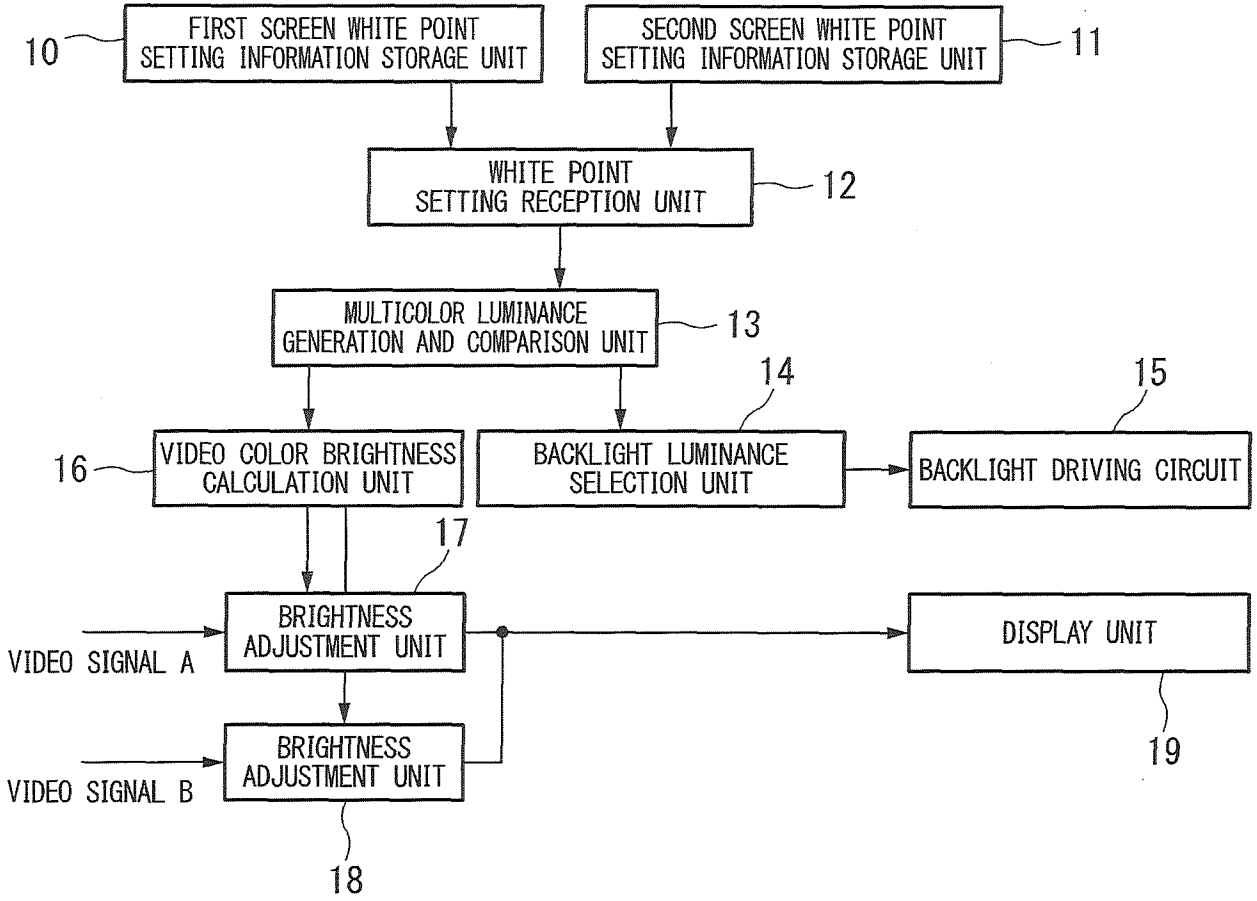
FIG. 1 is a schematic block diagram illustrating a configuration of a display device in the present embodiment.

Hereinafter, a display device in the present invention will be described with reference to drawings. FIG. 1 is a schematic block diagram illustrating a configuration of a display device 1 in the present embodiment.

The display device 1 is a display device which illuminates a liquid crystal panel using backlights for primary colors of R (red), G (green) and B (blue) from a display back surface and displays a color image. Here, the display device 1 has a function of displaying both a screen corresponding to a first video signal and a screen corresponding to a second video signal on one display screen.

Figure 2:
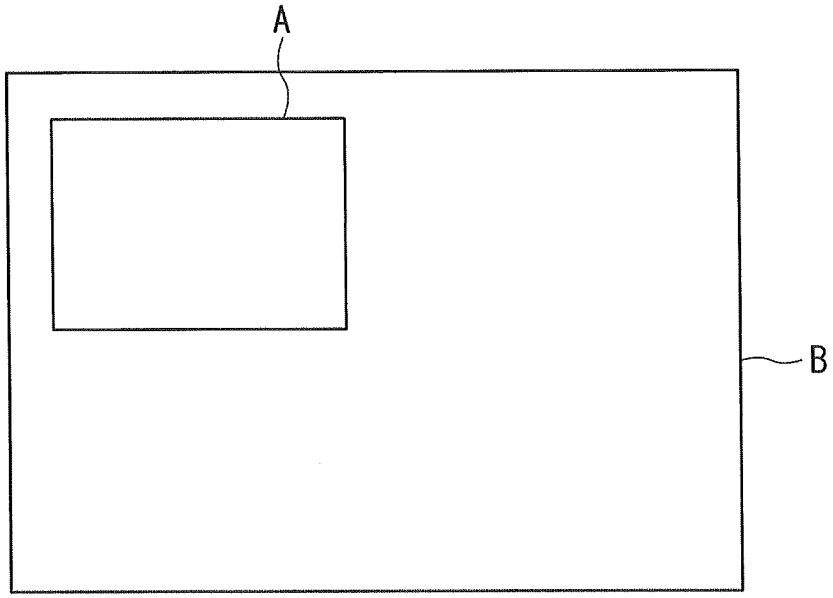
FIG. 2 is a diagram illustrating an example of a screen to be displayed on the display device.

FIG. 2 is a diagram illustrating an example of a screen displayed on the display device 1. The display device 1 has a function of displaying both a screen (reference sign A) based on a first video signal and a screen (reference sign B) based on a second video signal on one display screen, as shown in FIG. 2. In FIG. 2, a case in which a plurality of screens having different white points are displayed on the same screen is illustrated. An image is displayed with a luminance of 80 cd/m$^2$ and a color temperature of 5000 K on the screen (reference sign A) based on the first video signal, and an image is displayed with a luminance of 70 cd/m$^2$ and a color temperature of 9300 K on the screen (reference sign B) based on the second video signal.

A first screen white point setting information storage unit 10 stores white setting information to be set for a first screen which is the screen corresponding to the first video signal. A second screen white point setting information storage unit 11 stores white setting information to be set for a second screen which is the screen corresponding to the second video signal. Here, the white setting information is stored in the first screen white point setting information storage unit 10 and the second screen white point setting information storage unit 11 according to an instruction input by a user of the display device 1. The white setting information refers to information indicating white point luminance and chromaticity. For example, a luminance "80 cd/m$^2$" is stored in the first screen white point setting information storage unit 10, and a luminance "70 cd/m$^2$" is stored in the second screen white point setting information storage unit 11. Here, as the white setting information, a color temperature "5000 K" is stored in the first screen white point setting information storage unit 10, and a color temperature "9300 K" is stored in the second screen white point setting information storage unit 11.

A white point setting reception unit 12 reads the white setting information (#0) stored in the first screen white point setting information storage unit 10 and the white setting information (#1) stored in the second screen white point setting information storage unit 11.

A multicolor luminance generation and comparison unit 13 receives the pieces of the white setting information (#0 and #1) read by the white setting reception unit 12, converts the white point setting information for each screen to required multicolor luminance (#2) based on each piece of the input white setting information, and compares the required luminances for screens. Here, the required multicolor luminance is, for example, RGB required luminance of the backlight.

Here, the required luminance is obtained for each screen and for each color of the backlight.

Figure 3:
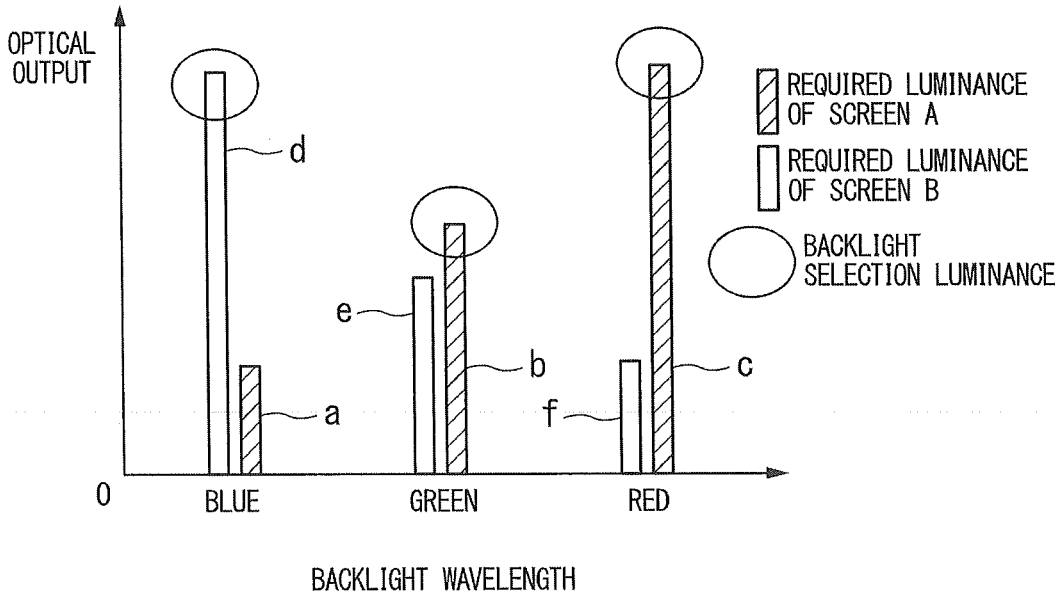
FIG. 3 is a diagram illustrating a required multicolor luminance converted from white setting information by a multicolor luminance generation and comparison unit.

FIG. 3 is a diagram illustrating a required multicolor luminance converted from the white setting information by the multicolor luminance generation and comparison unit 13. In FIG. 3, a vertical axis indicates an optical output, and a horizontal axis indicates a backlight wavelength (B, G and R).

The multicolor luminance generation and comparison unit 13 converts the white setting information stored in the first screen white point setting information storage unit 10 to a required luminance of a screen A. For each of the first video signal and the second video signal, the multicolor luminance generation and comparison unit 13 calculates a required luminance according to a set luminance for each color of the backlight, and obtains the higher one of the required luminance corresponding to the first video signal and the required luminance corresponding to the second video signal as objective luminance for each color based on a calculation result.

More specifically, the multicolor luminance generation and comparison unit 13 obtains values of an optical output (reference sign a) of a blue backlight, an optical output (reference sign b) of a green backlight, and an optical output (reference sign c) of a red backlight as the required luminance in the screen A.

Further, the multicolor luminance generation and comparison unit 13 converts the white setting information stored in the second screen white point setting information storage unit 11 to a required luminance of the screen B. The multicolor luminance generation and comparison unit 13 obtains values of an optical output (reference sign d) of the blue backlight, an optical output (reference sign e) of the green backlight, and an optical output (reference sign f) of the red backlight as the required luminance in the screen B.

Further, the multicolor luminance generation and comparison unit 13 compares, for each color, the required luminances obtained for the screens, selects the highest luminance for each color, and outputs the highest luminance to a backlight luminance selection unit 14 as an objective backlight luminance. For example, in FIG. 3, the multicolor luminance generation and comparison unit 13 compares the required luminances of the screen A and the screen B for each of blue, green, and red, and compares optical outputs corresponding to the required luminances of the screen A and the screen B to check which is greater. In FIG. 3, for blue, the optical output (reference sign d) corresponding to the required luminance of the screen B is greater. For green, the optical output (reference sign b) corresponding to the required luminance of the screen A is greater, and for red, the optical output (reference sign c) corresponding to the required luminance of the screen A is greater. Therefore, in this case, the multicolor luminance generation and comparison unit 13 determines that the required luminance (reference sign d) of the screen B in blue, the required luminance (reference sign b) of the screen A in green, and the required luminance (reference sign c) of the screen A in red are higher, and outputs a determination result to the backlight luminance selection unit 14 as the objective backlight luminance.

Further, the multicolor luminance generation and comparison unit 13 compares the required luminance with the objective luminance and detects, for each color, the required luminance corresponding to the video signal lower than the objective luminance among the required luminance corresponding to the first video signal and the required luminance corresponding to the second video signal. In other words, the multicolor luminance generation and comparison unit 13 compares, for each color, the required luminance of each screen with the obtained objective backlight luminance described above and detects a color in which the required luminance is lower than the objective backlight luminance.

In FIG. 3, the multicolor luminance generation and comparison unit 13 detects the optical output (reference sign a) of blue of the screen A, the optical output (reference sign e) of green of the screen B, and the optical output (reference sign f) of red of the screen B. The multicolor luminance generation and comparison unit 13 outputs a detection result to a video color brightness calculation unit 16.

The backlight luminance selection unit 14 obtains the objective backlight luminance output from the multicolor luminance generation and comparison unit 13 and outputs the objective backlight luminance to a backlight driving circuit 15.

The backlight driving circuit 15 drives each of colors R, G and B of the backlight to have a luminance according to the objective backlight luminance output from the backlight luminance selection unit 14. Here, each of the colors R, G and B is driven to have the objective luminance using the required luminance (reference sign d in FIG. 3) of the screen B as the objective luminance of blue, the required luminance (reference sign b in FIG. 3) of the screen A as the objective luminance of green, and the required luminance (reference sign c) of the screen A as the objective luminance of red. This driving scheme is any of various schemes but, for example, there is a scheme of driving power to be supplied to the backlight based on PWM (pulse width modulation). Further, here, the backlight to be driven is, for example, an LED (light emitting diode) corresponding to each of the colors R, G and B.

The video color brightness calculation unit 16 adjusts the video signal for each color so that the video signal of the screen corresponding to the color of the backlight with the required luminance lower than the backlight luminance is darkened, based on the output from the multicolor luminance generation and comparison unit 13. For example, the video color brightness calculation unit 16 adjusts the video signal and displays a dark image for the optical output (reference sign a in FIG. 3) of blue of the screen A, the optical output (reference sign e in FIG. 3) of green of the screen B, and the optical output (reference sign f in FIG. 3) of red of the screen B.

Figure 4:
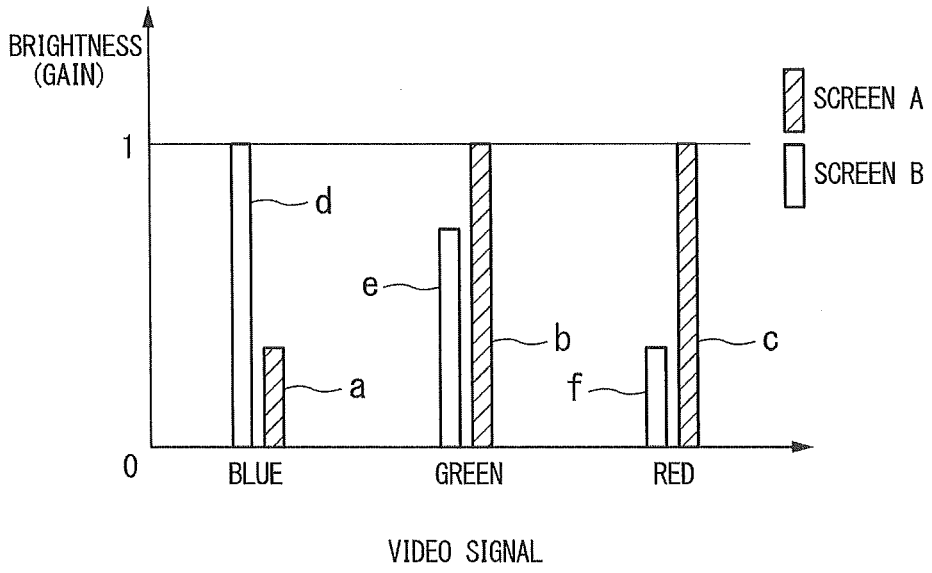
FIG. 4 is a diagram illustrating brightness of a video signal for each screen.

FIG. 4 is a diagram illustrating brightness of a video signal for each screen. A vertical axis indicates brightness and, herein, indicates a signal input-to-output ratio (gain). A horizontal axis indicates a wavelength (blue, green and red) of the video signal. Here, the backlight is driven using a required luminance (reference sign d in FIG. 3) of a screen B in blue, a required luminance (reference sign b in FIG. 3) of the screen B in green, and a required luminance (reference sign c) of the screen A in red as objective backlight luminance Therefore, brightness of the screen A in blue, brightness of the screen B in green and brightness of the screen B in red are calculated when brightness of the screen B in blue, brightness of the screen A in green, and brightness of the screen A in red are 1, and such brightness that images corresponding to the video signal of the screen A in blue, the video signal of the screen B in green, and the video signal of the screen B in red are darkened is calculated according to the obtained brightness. For example, for a color of an emission color, the calculation is performed in such a manner that the image of the video signal is darkened based on a ratio of optical outputs of the backlight for the screen A and the screen B.

A brightness adjustment unit 17 adjusts the brightness of the first video signal (e.g., the signal image A) based on a calculation result of the video color brightness calculation unit 16. For example, when the calculation result to decrease the brightness for blue of the screen A is output from the video color brightness calculation unit 16, the brightness adjustment unit 17 adjusts the video signal so that the brightness of the screen A (the video signal A) in blue decreases according to the output calculation result.

A brightness adjustment unit 18 adjusts the brightness of the second video signal (e.g., signal image B) based on the calculation result of the video color brightness calculation unit 16. For example, when the calculation result to decrease the brightness for green of the screen B and red of screen B is output from the video color brightness calculation unit 16, the brightness adjustment unit 18 adjusts the video signal so that the brightness of green and the brightness of red of the screen A (the video signal B) decrease according to the output calculation result.

Here, when the image is adjusted to be darkened, a change in a halftone becomes a problem. However, the brightness adjustment unit 17 and the brightness adjustment unit 18, for example, adjust the video signal using a gamma LUT (Look-Up Table) for video signals corresponding to R, G and B to be included in the video signal. Thus, it is possible to suppress image quality deterioration by performing gamma correction on a target video signal so that the image is darkened. Further, a circuit for a video attenuator/brightness/contrast or the like may be used. Further, the brightness adjustment unit 17 and the brightness adjustment unit 18 may not perform darkening correction on a video signal corresponding to a color of the screen for which decrease in the brightness is not instructed by the video color brightness calculation unit 16.

A display unit 19 is, for example, a liquid crystal panel, and displays images corresponding to the video signal A adjusted by the brightness adjustment unit 17 and the video signal B adjusted by the brightness adjustment unit 18.

According to the embodiment described above, it is possible to display both the screen A and the screen B with desired white points.

Figure 5:
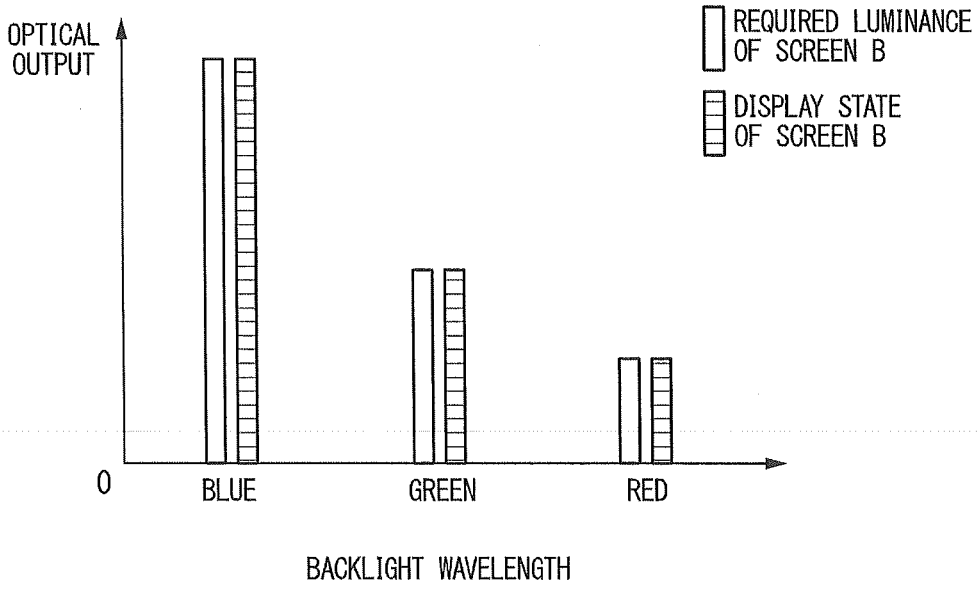
FIG. 5 is a diagram illustrating a relationship between an optical output corresponding to a required luminance in a screen B and an optical output of the screen B displayed on a display unit.
Figure 6:
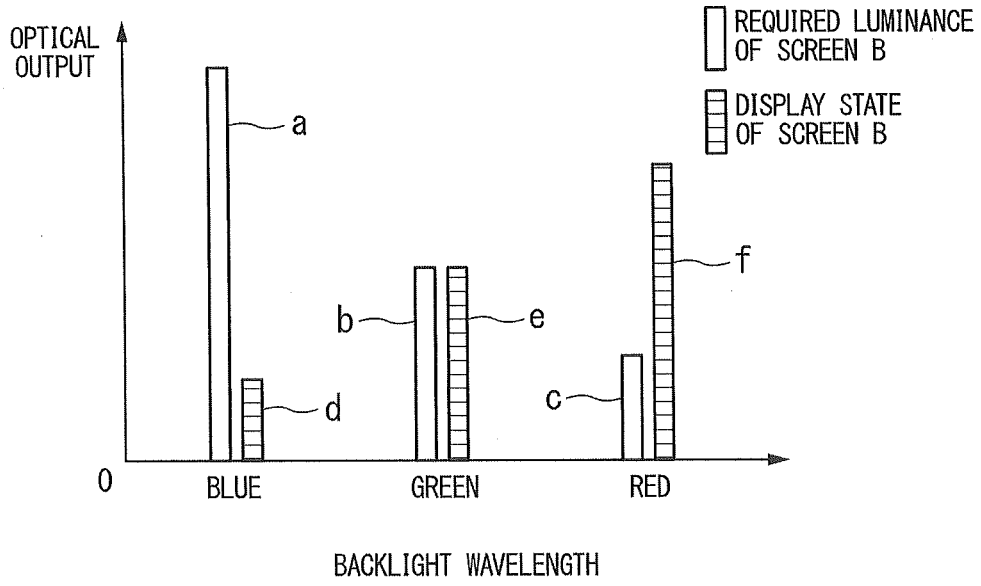
FIG. 6 is a diagram illustrating a relationship between a wavelength of a backlight and an optical output when two screens are displayed by one display device.
Figure 7:
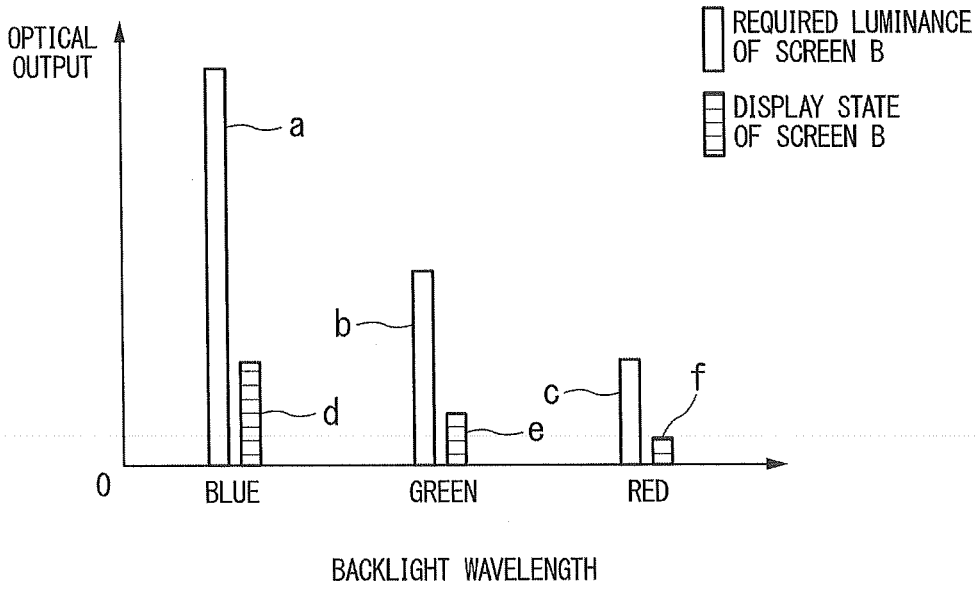
FIG. 7 is a diagram illustrating a relationship between a wavelength of a backlight and an optical output when chromaticity is fitted to a setting value by adjusting a video signal.
Figure 8:
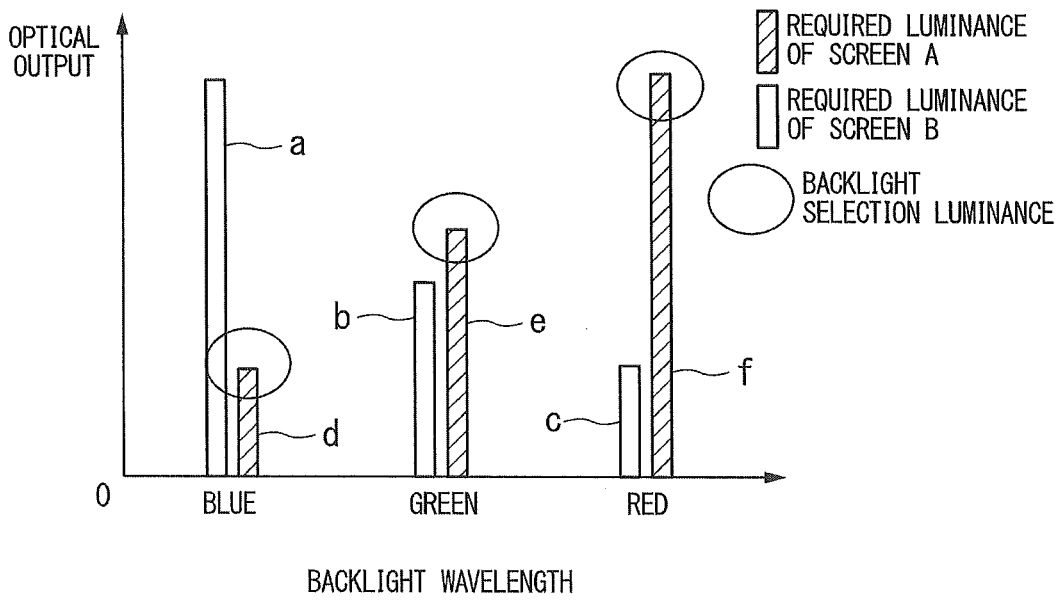
FIG. 8 is a diagram illustrating a required backlight luminance for each screen.

FIG. 5 is a diagram illustrating a relationship between an optical output corresponding to the required luminance in the screen B and an optical output of the screen B to be displayed on the display unit 19. In FIG. 5, optical outputs of R, G, and B to be included in white of the screen B are compared. Here, an optical output of a setting value (the required luminance) and a display state of an image actually displayed on the display unit 19 substantially match in each color. In other words, even the screen having a lower luminance among a plurality of screens (the screen A and the screen B) having different white point settings can be correctly displayed.

According to the embodiment described above, the higher one of required backlight luminances of the screen A and the screen B is the objective backlight luminance for each color of the backlight such that the backlight is driven. Also, a video signal corresponding to the lower required backlight luminance is adjusted to be darkened. Accordingly, it is possible to simultaneously display a plurality of screens having different white point settings (e.g., a luminance of 80 cd/m$^2$ and a color temperature of 5000 K for the screen A and a luminance of 70 cd/m$^2$ and a color temperature 9300 K for the screen B) within one display screen of the same display device (e.g., FIG. 1).

Further, according to the embodiment described above, it is possible to improve image quality, power consumption, and an aged deterioration property of the display device since the backlight output can be minimized while maintaining objective image quality.

Further, in the embodiment described above, it is possible to select any color space, including the number of colors, in the multicolor luminance described above. The same color number and color space as those of the backlight is suitable for redundancy elimination, but a CIE1931XYZ color space or the like may be used for simplification.

Further, luminance and chromaticity management may be performed by recording a program for realizing the function of the display device 1 in FIG. 1 in a computer-readable recording medium and loading the program recorded in this recording medium to a computer system to be executed. Further, the "computer system" stated herein includes an OS or hardware such as a peripheral device.

Further, the "computer system" includes a homepage providing environment (or display environment) if a WWW system is being used.

Further, the "computer-readable recording medium" refers to a portable medium such as a flexible disk, a magnetic optical disc, a ROM, or a CD-ROM, or a storage device such as a hard disk embedded in the computer system. Further, the "computer-readable recording medium" also includes a recording medium that holds a program for a certain time, such as a volatile memory inside a computer system including a server and a client. Further, the program may be a program for realizing some of the above-described functions or may be a program capable of realizing the above-described functions through a combination with a program previously stored in the computer system. Further, the program described above may be stored in a predetermined server, and may be distributed (e.g., downloaded) via a communication line according to a request from another device.

While the embodiments of the present invention have been described above in detail with reference to the drawings, a concrete configuration is not limited to such embodiments and a design or the like without departing from of the spirit or scope of the present invention is also included.

INDUSTRIAL APPLICABILITY

The present invention relates to a display device which performs highly precise color reproduction and is particularly effective in the fields of displays for graphic design, printing offices, medical care or the like.

DESCRIPTION OF REFERENCE SYMBOLS

1: display device
10 first screen white point setting information storage unit
11 second screen white point setting information storage unit
12 white point setting reception unit
13 multicolor luminance generation and comparison unit
14 backlight luminance selection unit
15 backlight driving circuit
16 video color brightness calculation unit
17 brightness adjustment unit
18 brightness adjustment unit
19 display unit

The invention claimed is:

1. A display device in which a plurality of backlights for different primary colors are provided and a liquid crystal panel is irradiated from a display back surface by the backlights to display a color image, the display device comprising:

a display unit which displays two images of a first video signal and a second video signal on one screen;

a luminance and color temperature setting unit which sets a luminance and a color temperature of white points of the first video signal and the second video signal;

a calculation unit which calculates, for each of the colors of the backlights, a required luminance according to the set luminance for each of the first video signal and the second video signal, and obtains the higher one of the required luminance corresponding to the first video signal and the required luminance corresponding to the second video signal as an objective luminance for each color based on a calculation result;

a backlight driving unit which drives the backlight for each color according to the objective luminance for each color obtained by the calculation unit;

a detection unit which compares the required luminance with the objective luminance and detects, for each color, the required luminance corresponding to the video signal lower than the objective luminance among the required luminance corresponding to the first video signal and the required luminance corresponding to the second video signal; and a brightness adjustment unit which performs adjustment for each color so that an image corresponding to the video signal lower than the objective luminance among the required luminance corresponding to the first video signal and the required luminance corresponding to the second video signal is darkened according to a detection result of the detection unit.

2. A display method in a display device in which a plurality of backlights for different primary colors are provided and a liquid crystal panel is irradiated from a display back surface by the backlights to display a color image, the display method comprising:

receiving an input to set a luminance and a color temperature of white points of a first video signal and a second video signal;

calculating, for each of the colors of the backlights, a required luminance according to the set luminance for each of the first video signal and the second video signal, and obtaining the higher one of the required luminance corresponding to the first video signal and the required luminance corresponding to the second video signal as an objective luminance for each color based on a calculation result;

driving the backlight for each color according to the obtained objective luminance of each color;

comparing the required luminance with the objective luminance and detecting, for each color, the required luminance corresponding to the video signal lower than the objective luminance among the required luminance corresponding to the first video signal and the required luminance corresponding to the second video signal;

performing adjustment for each color so that an image corresponding to the video signal lower than the objective luminance among the required luminance corresponding to the first video signal and the required luminance corresponding to the second video signal is darkened according to a detection result; and displaying two images of the first video signal and the second video signal on one screen according to an adjustment result.

* * * * *